US007212881B2

(12) United States Patent
Kazuyoshi

(10) Patent No.: US 7,212,881 B2
(45) Date of Patent: May 1, 2007

(54) KNITTING METHOD FOR GARMENT WITH ASYMMETRICALLY JOINED SLEEVES, GARMENT WITH ASYMMETRICALLY JOINED SLEEVES, AND KNIT DESIGN DEVICE

(75) Inventor: Okamoto Kazuyoshi, Wakayama (JP)

(73) Assignee: Shima Seiki Manufacturing, Ltd., Wakayama (JP)

( * ) Notice: Subject to any disclaimer, the term of this patent is extended or adjusted under 35 U.S.C. 154(b) by 0 days.

(21) Appl. No.: 10/566,441

(22) PCT Filed: Jul. 22, 2004

(86) PCT No.: PCT/JP2004/010397

§ 371 (c)(1),
(2), (4) Date: Jan. 31, 2006

(87) PCT Pub. No.: WO2005/012611

PCT Pub. Date: Feb. 10, 2005

(65) Prior Publication Data

US 2006/0248928 A1 Nov. 9, 2006

(30) Foreign Application Priority Data

Aug. 1, 2003 (JP) ..... 2003-284725

(51) Int. Cl.
*D04B 7/10* (2006.01)

(52) U.S. Cl. ..... 700/141; 66/176; 66/64

(58) Field of Classification Search ..... 66/64, 66/70, 170–176, 189; 700/141

See application file for complete search history.

(56) References Cited

U.S. PATENT DOCUMENTS

| | | | | |
|---|---|---|---|---|
| 3,702,068 | A * | 11/1972 | Betts et al. | 66/176 |
| 5,826,445 | A * | 10/1998 | Okamoto | 66/70 |
| 5,987,930 | A * | 11/1999 | Nakai | 66/69 |
| 6,286,340 | B1 * | 9/2001 | Yui | 66/70 |
| 6,564,588 | B1 * | 5/2003 | Nonnenmacher et al. | 66/69 |
| 6,581,417 | B2 * | 6/2003 | Yui | 66/176 |
| 6,651,462 | B2 * | 11/2003 | Okamoto | 66/64 |
| 6,655,175 | B1 * | 12/2003 | Okamoto | 66/69 |
| 6,658,899 | B2 * | 12/2003 | Okamoto | 66/64 |
| 6,748,770 | B2 * | 6/2004 | Okamoto | 66/64 |
| 6,889,530 | B2 * | 5/2005 | Urano et al. | 66/64 |

FOREIGN PATENT DOCUMENTS

| | | | |
|---|---|---|---|
| JP | 3-75656 | B2 | 12/1991 |
| JP | 2706760 | B2 | 1/1998 |
| JP | 2000-256947 | A | 9/2000 |
| JP | 3071147 | B2 | 5/2001 |

(Continued)

*Primary Examiner*—Danny Worrell
(74) *Attorney, Agent, or Firm*—Rothwell, Figg, Ernst & Manbeck

(57) ABSTRACT

Both sleeves and front and back bodies are joined using gores such that the gores between the front body and both front sleeves become larger than the gores between the back body and both back sleeves. The knitted fabric is rotated such that, for example, the border between the front side and the backside of the left sleeve is positioned between front and back needle beds. In this state, the left sleeve is joined to the front body. The knitted fabric is rotated again such that the border between the front side and the backside of the right sleeve is positioned between the front and back needle beds for joining the right sleeve to the front body.

4 Claims, 13 Drawing Sheets

FOREIGN PATENT DOCUMENTS

| | | | |
|---|---|---|---|
| JP | 3164507 | B2 | 5/2001 |
| JP | 3164528 | B | 5/2001 |
| JP | 3406085 | B2 | 5/2003 |
| WO | WO 00/12799 | A1 | 3/2000 |
| WO | WO 01/55491 | A1 | 8/2001 |
| WO | WO 01/88243 | A1 | 11/2001 |
| WO | WO 01/94671 | A1 | 12/2001 |

* cited by examiner

: 34 KNITTING COURSE

: 36 OVERLAPPING STITCHES

: 38 REDUCTION IN KNITTING WIDTH

FORMATION OF BOTH GORES HAS BEEN FINISHED

: 34 KNITTING COURSE

× × : 36 OVERLAPPING STITCHES

: 38 REDUCTION IN KNITTING WIDTH

Prior Art

F JOIN ONE KNIT STITCH OF LEFT FRONT SLEEVE

B JOIN ONE KNIT STITCH OF LEFT BACK SLEEVE

Prior Art

KNITTING METHOD FOR GARMENT WITH ASYMMETRICALLY JOINED SLEEVES, GARMENT WITH ASYMMETRICALLY JOINED SLEEVES, AND KNIT DESIGN DEVICE

CROSS REFERENCE TO RELATED APPLICATION

This application is a 35 USC § 371 National Phase Entry Application from PCT/JP2004/010397, filed Jul. 22, 2004, and designating the United States.

TECHNICAL FIELD

The present invention relates to knitting of a garment such as a sweater, a vest, a one-piece suit, and a dress. In particular, the present invention relates to knitting of a garment with asymmetrically joined front and back sleeves and asymmetrically joined front and back bodies. The sleeves are oriented forward such that the garment fits the body shape of human. Further, the present invention relates to a knitting method for such a garment with asymmetrically joined sleeves, the garment with asymmetrically joined sleeves produced by knitting, and a knit design device for generating the required knitting data.

BACKGROUND ART

The applicant contrived a technique of knitting by a flat knitting machine to produce a cylindrical knitted fabric without sewing, and successively putted the technique into practical use. Japanese Patent Publication No. 3-75656 proposes a knitting method for knitting a cylindrical rib using a flat knitting machine having two beds. The method is known as broad rib knitting. In the method, every other needle in the front and back needle beds is used. Japanese Laid-Open Patent Publication No. 8-158209 proposes a method of joining two knitted fabrics. For example, five knit stitches of one knitted fabric are joined to five knit stitches of the other knitted fabric. In this case, the knitted fabrics are joined together such that knit stitches at the center of one knitted fabric are overlapped with knit stitches at the center of the other knitted fabric, or knit stitches at both ends of one knitted fabric are overlapped with knitted stitches at both ends of the other knitted fabric.

Japanese Laid-Open Patent Publication No. 9-310254, Japanese Laid-Open Patent Publication No. 10-226947, and Japanese Laid-Open Patent Publication No. 10-77556 propose methods for joining knitted fabrics or cast off stitches. WO00/12799 discloses a knitting method for permitting the entry of an upper end of a front body into a back body beyond a shoulder line. WO01/55491 discloses a method of knitting a neckline. WO01/88243 discloses a method of knitting a gore between a sleeve and a body. WO01/94671 discloses a method of joining a T-sleeve and a body.

In the textile product, it is a common practice that asymmetrically joined front and back sleeves are provided for fitting the body shape of human. However, as the knit product without sewing, no sweater with asymmetrically joined front and back sleeves has been produced so far. If the front sleeve and the back sleeve are asymmetrically joined such that the sleeves are oriented forward, the garment (sweater) can be worn as the comfortable cloth. However, as the knitting method without sewing, no method for knitting such a sweater is known.

SUMMARY OF THE INVENTION

An object of the present invention is to provide a method of knitting a garment with asymmetrically joined front and back sleeves substantially without sewing in which when the garment is worn, the sleeves are oriented forward, and fits the human body, to provide such a garment, and to provide a knit design device for generating the required knitting program.

In a method of knitting a garment with asymmetrically joined sleeves according to the present invention, on a flat knitting machine having a pair of front and back needle beds, a body and both sleeves are knitted up to underarm positions to have cylindrical shapes, respectively. Then, both sleeves are joined to the body, and then, upper ends of a front body and a back body of the body are joined together. The method comprises the steps of: (a) forming gores at the underarm positions for connecting front sleeves of both the sleeves and the front body without forming any gores between back sleeves of both the sleeves and the back body, or forming gores at the underarm positions for connecting both the front sleeves and the front body such that the gores between both the back sleeves and the back body become smaller than the gores between both the front sleeves and the front body in the case of forming the gores between both the back sleeves and the back body; (b) rotating at least one of the sleeves and the body in a first direction on the flat knitting machine such that a border between a front side and a backside of the one of the sleeves is positioned between the pair of front and back needle beds, and while knitting the one of the sleeves and the front and back bodies, joining the front and back bodies to the one of the sleeves; and (c) rotating at least the other of the sleeves in a direction opposite to the first direction on the flat knitting machine such that a border between a front side and a backside of the other of the sleeves is positioned between the pair of front and back needle beds, and while knitting the other of the sleeves and the front and back bodies, joining the front and back bodies to the other of the sleeves. Preferably, the step (b) and the step (c) are repeated alternately.

In the specification, "without sewing" means the knitting method in which sewing is not carried out at all, or the knitting method in which no sewing is carried out at the time of forming the gores, and joining the sleeves and the body. The upper/lower, left/right, and back/front sides of the garment are determined based on the state in which the garment is worn on the body. Knitting is started from the lower side. The neck hole and collar are present on the upper side. The front side or the backside, and the racking (swaying) direction are determined based on the state as viewed from the front side toward the knitting machine. The front side may be simply referred to as the "front", and the backside may be simply referred to as the "back". Left swaying as viewed from the front side is referred to as "racking to the left", and right swaying as viewed from the front side is referred to as "racking to the right".

Further, according to the present invention, a garment with asymmetrically joined sleeves includes a body comprising a cylindrical knitted fabric and both sleeves. Each of the cylindrical knitted fabric and both sleeves comprises a cylindrical knitted fabric. The body and both sleeves are joined on sides by knitting operation without sewing, and a front body and a back body of the body are joined at shoulders. In the invention, (a) front portions of both the sleeves are joined to the front body at underarm positions using gores such that knitting widths of front sleeves of the sleeves becomes narrower than knitting widths of back sleeves of the sleeves above the underarm positions;

(b) the front portions of both the sleeves are joined to the front body at the underarm positions using the gores such that a knitting width of the front body becomes narrower than a knitting width of the back body above the underarm positions; and (c) the front body and the back body are joined to both the sleeves by overlapping knit stitches without any twist on sides.

Further, a knit design device according to the present invention is generating knitting data for knitting a garment by knitting a body and both sleeves up to underarm positions to have cylindrical shapes, respectively, then, joining both the sleeves to the body, and then, joining upper ends of a front body and a back body of the body, on a flat knitting machine having a pair of front and back needle beds, the knitting data being used by the flat knitting machine for carrying out the steps of:

(a) forming gores at the underarm positions for connecting front sleeves of both the sleeves and the front body without forming any gores between back sleeves of both the sleeves and the back body, or forming gores at the underarm positions for connecting both the front sleeves and the front body such that the gores between both the back sleeves and the back body become smaller than the gores between both the front sleeves and the front body in the case of forming the gores between both the back sleeves and the back body;

(b) rotating at least one of the sleeves and the body in a first direction on the flat knitting machine such that a border between a front side and a backside of the one of the sleeves is positioned between the pair of front and back needle beds, and while knitting the one of the sleeves and the front and back bodies, joining the front and back bodies to the one of the sleeves; and (c) rotating at least the other of the sleeves in a direction opposite to the first direction on the flat knitting machine such that a border between a front side and a backside of the other of the sleeves is positioned between the pair of front and back needle beds, and while knitting the other of the sleeves and the front and back bodies, joining the front and back bodies to the other of the sleeves, The knitting data is used by the flat knitting machine for carrying out the steps in the order of (a) to (c).

ADVANTAGES OF THE INVENTION

In the present invention, the front sleeves and the front body are connected using the gores (front gores) such that the front gores become larger than the gores (back gores) connecting the back sleeves and back body, or no back gores are formed. Assuming that the knitting width of the front body and the knitting width of the back body are the same up to the underarm positions, since the gores are only present on the front body side, or since the length of the front gores is different from the length of the back gores, the knitting width of the front body becomes smaller than the knitting width of the back body above the underarm positions. Therefore, the borders between the front sleeves and the back sleeves are present on the side of the front sleeves. The sleeves are oriented to the front side, and the garment has a silhouette which fits the body shape of human. Thus, the garment fits the human body when it is worn. Further, wrinkles are few on the front side of the sleeves, and the stress of the knitted fabric is small on the backside of the sleeves.

Since asymmetrical front and back gores are formed, if the sleeve and the body are joined together in an ordinary manner, twisted stitches are formed undesirably. For reference, FIG. 14 shows knitting operation for joining both sleeves and the body in a conventional example. B, B' denote both ends of a front body 4, E, E' denote both ends of a back body 6, and h, h' denote outer borders between the front side and the back side of both sleeves 8, 10. Knitting operation is performed from the step on the lower side to the step on the upper side in FIG. 14. After the back knitted fabric is knitted one course, by racking the knitted fabric of the right back sleeve to the inside of the knitting width, one stitch is joined. Then, the front body is knitted one course from the left front sleeve. By racking the left front sleeve and the left back sleeve inwardly, one knit stitch of the left front sleeve and one knit stitch of the left back sleeve are overlapped with, and joined to the knit stitches of the body. Further, by racking the right front sleeve, one knit stitch of the right front sleeve is joined. Thereafter, the front body with the left front sleeve, and the left back sleeve with the back body are knitted one course, respectively. One knit stitch of the left back sleeve and one knit stitch of the right back sleeve are joined. The back body is knitted one course. One knit stitch of the left back sleeve is joined. The back body with the right back sleeve is knitted one course. One knit stitch of the left front sleeve is joined. Further, the right front sleeve with the front body is knitted one course. One knit stitch of the left front sleeve, one knit stitch of the right front sleeve, and one knit stitch of the right back sleeve are joined. Thereafter, the front body with the right front sleeve is knitted one course. One knit stitch of the right front sleeve is joined. In every knitting operation, two courses of the sleeve are knitted, four courses of the body are knitted, and three knit stitches of the sleeves are joined. Therefore, the knitting operation is referred to as the knitting operation of 2(the number of knitting courses of the sleeve): 4(the number of knitting courses of the body): 3(the number of joined knit stitches).

In the knitting operation shown in FIG. 14, since no asymmetrical front and back gores are formed, the borders h, h' between the front side and the backside of the sleeves are positioned between the front and back needle beds. However, if asymmetrically joined front and back gores are formed, the borders h, h' appear on the front sleeve side, and causes formation of twisted stitches. As shown in FIG. 15, if a knit stitch 100 at the end is transferred, the knit stitch 100 becomes a twisted stitch 101. If a knit stitch 102 in the next course is formed on the twisted stitch 101, the twisted stitch 101 remains in the twisted state. If the conventional knitting operation for joining the sleeve and the body is performed by providing the asymmetrically joined front and back gores, the knit stitch rotated from the back sleeve to the front sleeve by the gore becomes the twisted stitch. If a new knit stitch of a new course is knitted on the twisted stitch, the twisted stitch remains, and the commercial value of the garment is lowered.

In the present invention, after the asymmetrical front and back gores are formed, at least one of the sleeves and the body is rotated on the flat knitting machine in a first direction. The border between the front side and the backside of one of the sleeves is positioned on the border between at least a pair of front and back needle beds. Thus, the twisted state of the knit stitch is eliminated. After the twisted state is eliminated, one of the sleeves, the front body, and the back body are knitted a suitable number of courses.

Further, a suitable number of stitches of one of the sleeves are joined to the front body and the back body. For joining the other of the sleeves, at least the other of the sleeves and the body are rotated on the flat knitting machine in the direction opposite to the first direction such that the border between the front side and the backside of the other of the sleeve is positioned on the border between at least the pair of front and back sleeves. Thus, the other of the sleeves is joined to the body, and the other of the sleeves and the body are knitted.

Preferably, joining of one of the sleeves and joining of the other of the sleeves are performed alternately. The type of sleeve attaching can be selected from a wide range of types such as T-sleeve, set-in sleeve, raglan sleeve depending on the number of knitting courses of the sleeve, the number of knitting courses of the body, the number of stitches for joining the sleeve and the body, and the position of the overlapping stitches formed by joining. After joining of the sleeve and the body is finished, for example, knitting of the front shoulder and the back shoulder, and joining of the front knitted fabric and the back knitted fabric is performed.

In the absence of the present invention, the front and back sleeve caps would be knitted by flechage knitting before formation of asymmetrical front and back gores such that the knitting width of the front sleeve cap becomes narrower than the knitting width of the back sleeve cap. In this case, even if the back sleeve is rotated to the front side, the knit stitch which has been knitted, and detached from the knitting needle does not become the twisted stitch. Therefore, twisted stitches appear in the final course of the sleeve cap. By overlapping the twisted stitches with the knit stitches of the body such that the twisted stitches are hidden under the knit stitches of the body, the twisted stitches cannot be seen easily. However, in the knitting method, flechage knitting is required, and it is preferable to use a flat knitting machine having a movable sinker device. In contrast, in the present invention, it is possible to carry out the knitting operation using the flat knitting machine which does not have any movable sinker device.

In the garment with asymmetrically joined sleeves according to the present invention, both sleeves are oriented forward naturally, and the garment fits the human body when it is worn. Further, when the garment with asymmetrically joined sleeves according to the present invention is worn, wrinkles are few on the front side, and the stress is small on the backside. Thus, a beautiful silhouette can be obtained.

In the knit design device according to the present invention, knitting data of the garment with asymmetrically joined sleeves can be generated.

EMBODIMENTS

Hereinafter, embodiments in the most preferred form for carrying out the present invention will be described.

Figure 1:
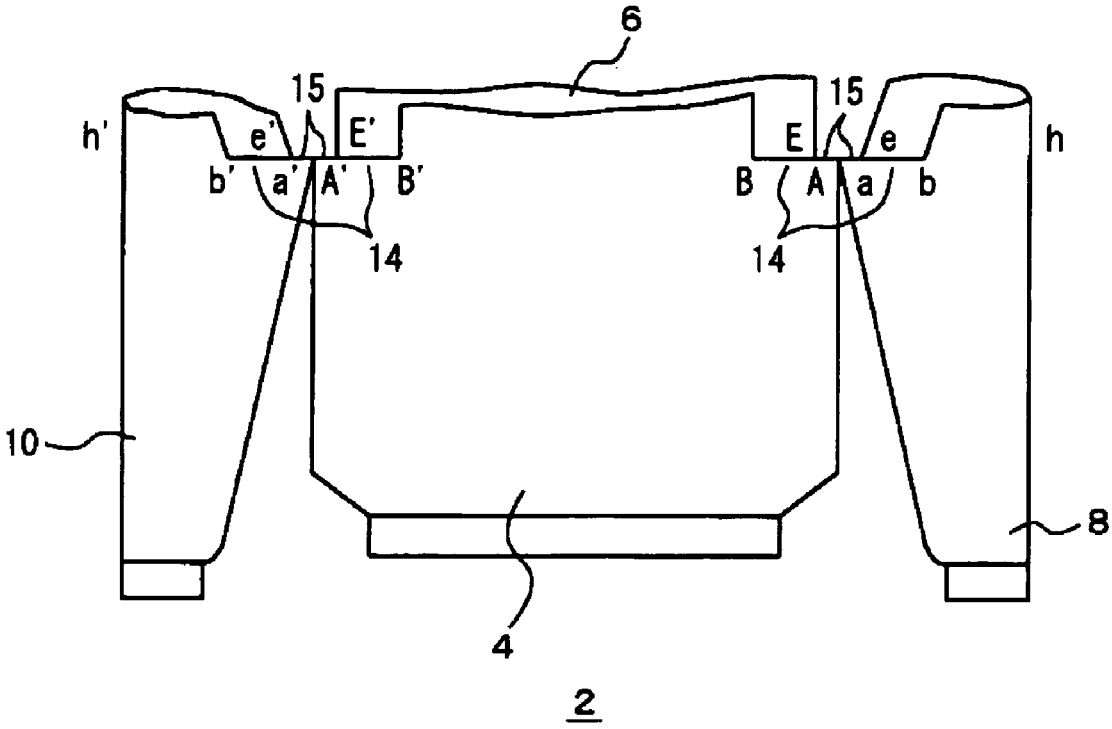
FIG. 1 is a view showing an example of a pattern of a sweater with asymmetrically joined sleeves knitted in an embodiment.
Figure 2:
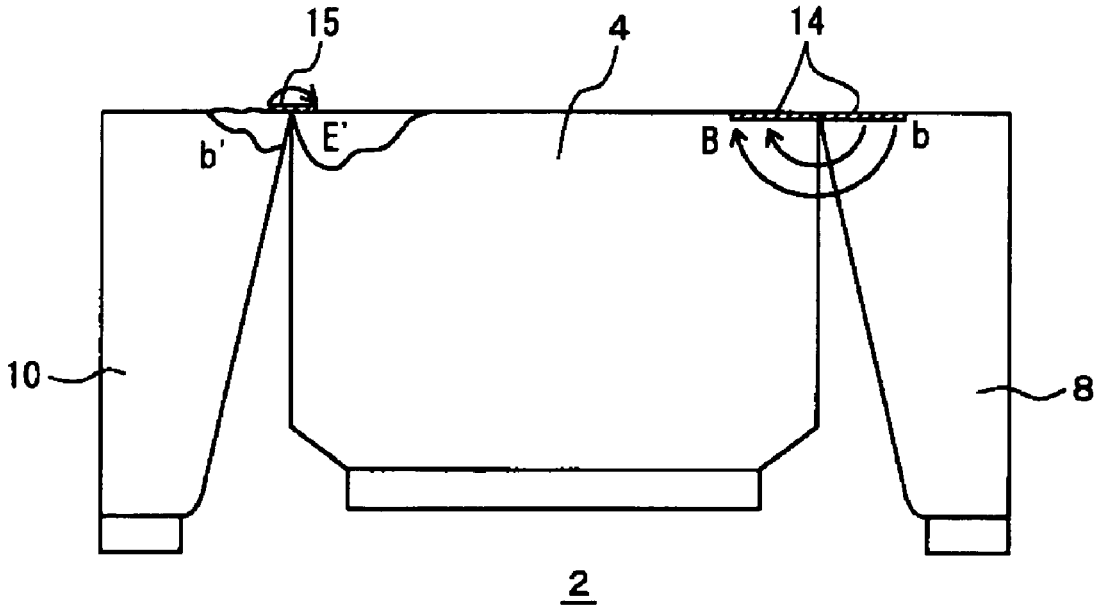
FIG. 2 is a view schematically showing knitting of asymmetrical front and back gores in the sweater with asymmetrically joined sleeves in FIG. 1.
Figure 3:
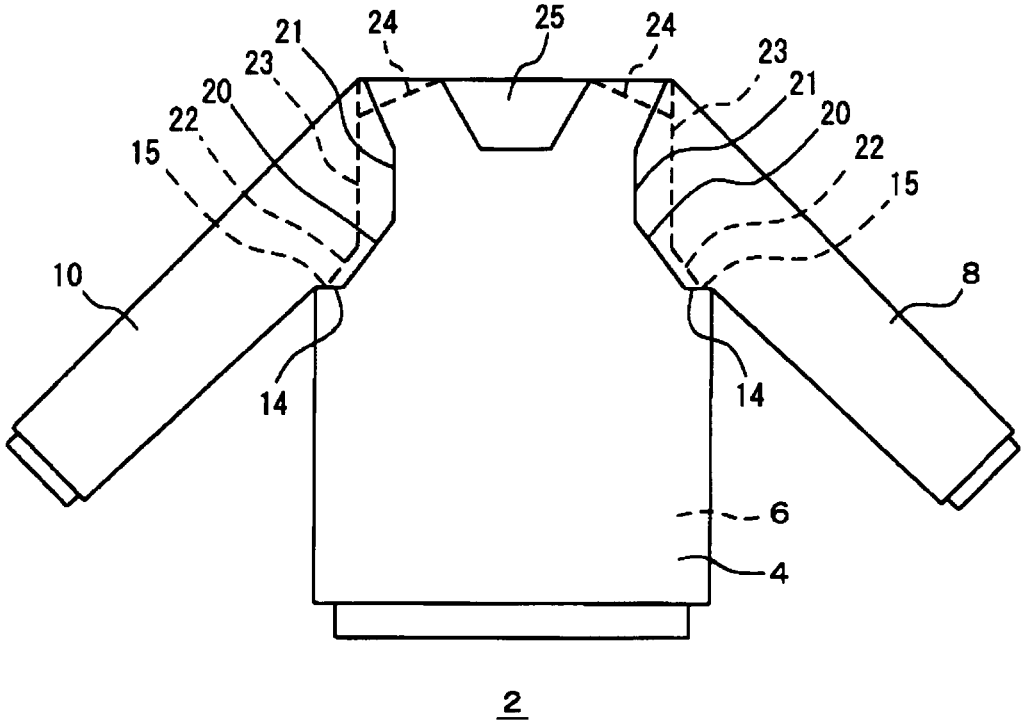
FIG. 3 is a view schematically showing the sweater of a set-in sleeve type with asymmetrically joined sleeves knitted in the embodiment.

An embodiment and its modified embodiment will be described with reference to FIGS. 1 to 13. FIGS. 1 to 3 show a sweater 2 of a set-in sleeve type knitted in the embodiment. A reference numeral 4 denotes a front body. A back body 6 is present on the backside of the front body 4, and a left sleeve 8 and a right sleeve 10 are present on the left and right sides of the front body 4. The left and right sides are determined based on the state in which the sweater 2 is worn. Therefore, the left and the right sides in the drawings appear oppositely to the normal left and right sides. In the drawings, lowercase letters denote positions on the sleeve side, and uppercase letters denote positions on the body side. The points denoted by corresponding alphabets, e.g., the lowercase letter "a" and the uppercase letter "A" are overlapped with each other at the same position by knitting.

Knitting of the front body 4 and the back body 6 is started from a portion of the bottom rubber. The front body 4 and the back body 6 are knitted to have a cylindrical shape up to the underarm positions. Likewise, knitting of the left sleeve 8 and the right sleeve 10 is started from portions of the bottom rubber. The left sleeve 8 and the right sleeve 10 are knitted to have cylindrical shapes, respectively. At the underarm positions, the left sleeve 8 is joined to the front body 4 and the back body 6 using a gore by joining the points (a, A), (b, B), and (e, E) together, and also in the right sleeve 10, a gore is formed such that the points (a', A'), (b', B'), and (e', E') are joined together. The outer borders between the front side and the backside of the sleeves 8, 10 are denoted by h, h'. Gore forming portions 14, 14 on the side of the front body and the front sleeves are wider than gore forming portions 15, 15 on the side of the back body and the back sleeves, by about two to six stitches. The gore forming portions 15 on the side of the back sleeves may not be provided. FIG. 2 schematically shows a state in which the gores have been formed. Arrows in FIG. 2 represent the joining direction at the gore.

Now, referring to FIG. 3, reference numerals 20, 21 denote joining lines between the front sleeves and the front body, and reference numerals 22, 23 denote joining lines between the back sleeves and the back body. For example, the joining lines 20, 22 are processed by knitting operation of 4(the number of knitting courses for the sleeve): 4(the number of knitting courses for the body): 4(the number of the narrowing stitches). The narrowing stitches are provided inside the body for gradually reducing the knitting width of the front body and the back body. At the joining lines 21, 23, knitting operation of 4(the number of knitting courses for the sleeves): 4(the number of knitting courses for the body): 2(the number of narrowing stitches) is performed for joining. Overlapping stitches are provided at the border between the sleeve and the body for gradually reducing the knitting width of the sleeve. The front shoulders and the back shoulders are joined at the joining lines 24. A reference numeral 25 denotes a neck hole.

The sweater 2 is produced without sewing. However, for example, sewing may be used for attaching the collar or the pocket. In the context of the present invention, the feature of "without sewing" is particularly meaningful in the portions of forming the gores, i.e., the gore forming portions 14, 15, joining both sleeves 8, 10 to the front body 4 and the back body 6, and joining the upper end of the front body 4 and the upper end of the back body 6. The garment with asymmetrically joined front and back sleeves may include a one-piece suit, a cardigan or the like in addition to the sweater. The sleeves may be long sleeves or short sleeves.

FIGS. 4 to 11 show a method of knitting the sweater 2. The numbers of the knitting steps, e.g., 1 to 6 are used independently in each of the drawings. The same number represents different steps in different drawings. The knitting operation is performed in the order of the step on the lower side to the step on the upper side in the drawings. It is assumed that a flat knitting machine having four needle beds (two needle beds for the front, and two needle beds for the back) is used, for example. Also in the case where a flat knitting machine having two needle beds, one for the front and the other for the back, is used, the knitting operation can be carried out in the same manner using the known broad rib knitting.

Both sleeves 8, 10 and the front and back bodies 4, 6 are knitted into cylindrical shapes up to the underarm positions. In step 1 of FIG. 4, a state of engagement between the body and the sleeves on the needle bed when knitting has been carried out up to the underarm positions is shown. In step 2, for knitting the gores, both sleeves are drawn toward the body side such that the sleeves are positioned alongside the body. At this time, the front body and both front sleeves are fixed to a lower front bed FD, and the back body and both back sleeves are fixed to a lower back bed BD. In step 3, the stitches of the left front sleeve are transferred to the upper back bed BU, and the stitches of the right back sleeve are transferred to the upper front bed FU such that a gore between the right back sleeve and the back body is formed, and about the half of a gore between the left front sleeve and the front body is formed. After step 3, and before step 4, the right back sleeve is transferred back to the original lower back bed BD. In step 4, while racking the upper and lower back beds to the left, the gore is formed between the left front sleeve and the front body. At this time, in order to prevent the yarn cut, the knit stitches at the end of the right back sleeve are sequentially rotated from the lower back bed BD to the lower front bed FD. Rotation will be described later with reference to FIG. 6.

Figure 4:
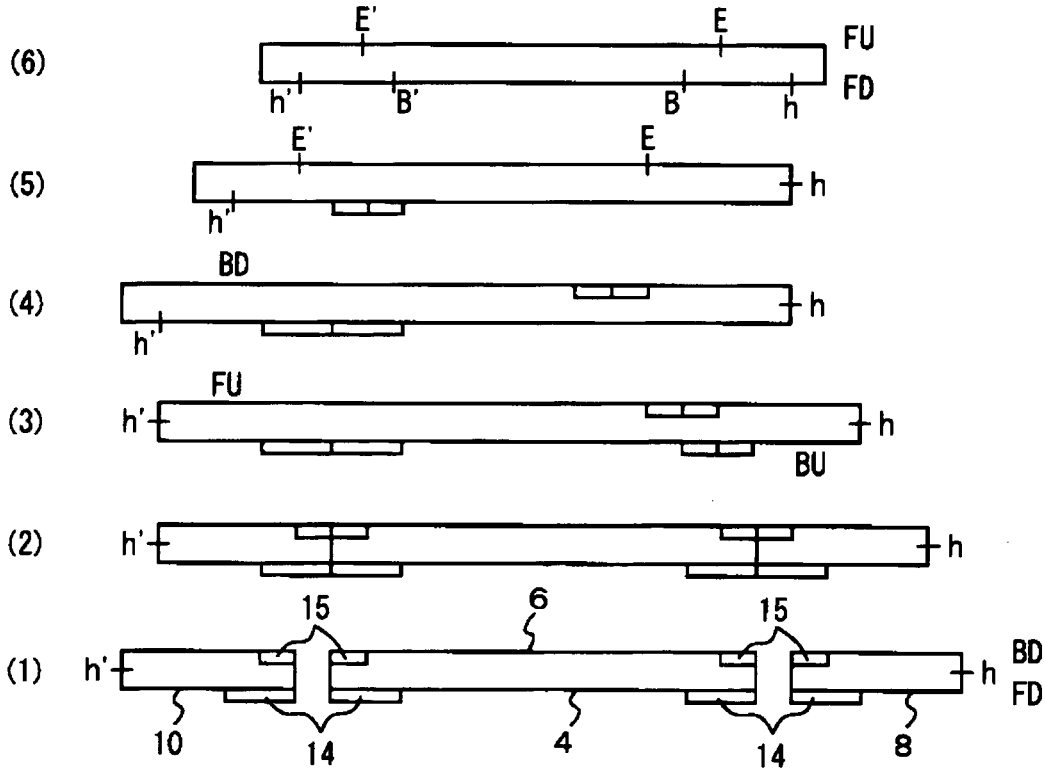
FIG. 4 is a view showing the overview of a method of knitting the asymmetrical front and back gores in the embodiment.

In step 4 of FIG. 4, formation of the gore between the front body and the left front sleeve is finished. Before step 5, the knit stitches of the left front sleeve are transferred from the upper back bed BU to the lower front bed FD, the knit stitches of the left back sleeve are transferred from the lower back bed BD to the upper front bed FU, and the knit stitches of the right front sleeve are transferred from the lower front bed FD to the upper back bed BU. In step 5, while racking the upper and lower back beds to the right side in FIG. 4, a gore between the back body and the left back sleeve is formed, and about the half of a gore between the front body and the right front sleeve is formed. After step 5, and before step 6, the stitches of the left back sleeve are transferred to the lower back bed BD. Then, in step 6, while racking the upper and lower back beds to the right side, the rest of the gore between the front body and the right front sleeve is formed, and the end of the left back sleeve is rotated to the lower front bed FD. After formation of the gore, for example, the knit stitches of the upper back bed BU are transferred to the lower front bed FD, and the knit stitches of the lower back bed BD are transferred to the upper front bed FU such that the knit stitches are assembled on the two beds. Thus, the left and right back sleeves are rotated toward the front bed. The borders h, h' between the front and back sleeves are shifted toward the front needle bed.

Figure 5:
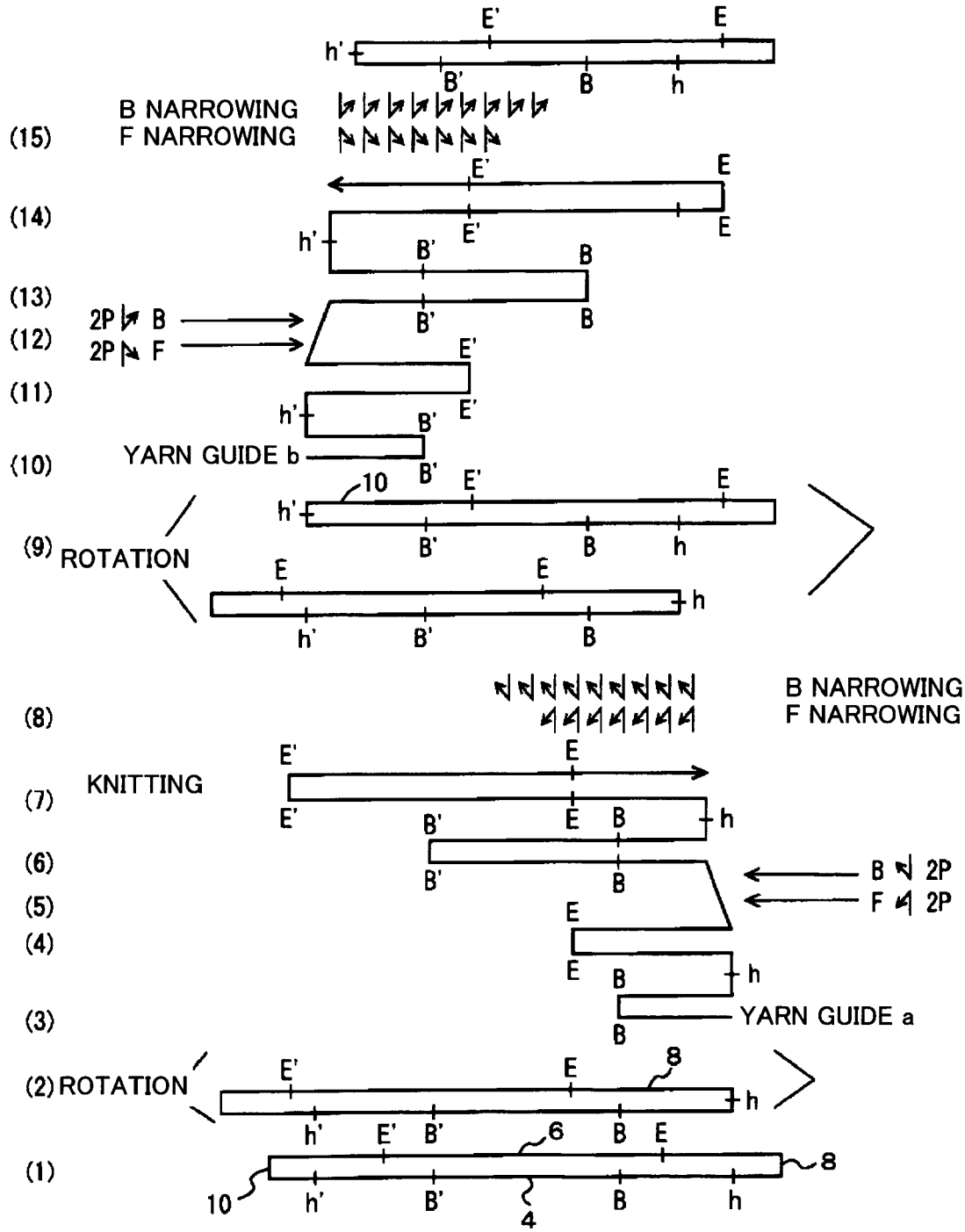
FIG. 5 is a view showing a knitting method in knitting operation of 4:4:4 in the embodiment.
Figure 6:
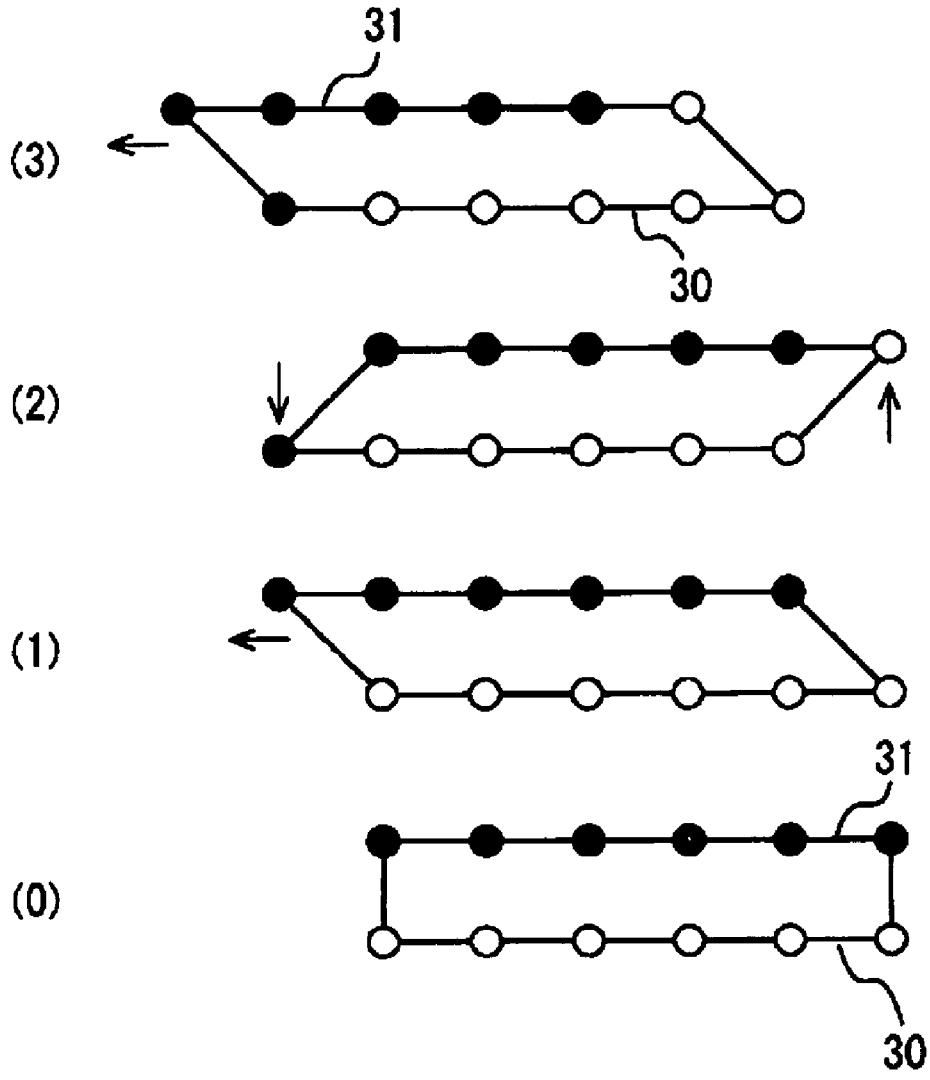
FIG. 6 is a diagram showing rotation operation used in knitting in FIG. 5.

FIG. 5 shows knitting operation of joining both sleeves and the body in the case of 4:4:4 (meaning of the expression has been described above). Step 1 shows a state in which formation of the gores has been finished. From this state, in step 2, the entire knitted fabric (hereinafter simply referred to as the "knitted fabric") is rotated, e.g., counterclockwise such that the border h between the front side and the backside of the left sleeve 8 is positioned between the front and back needle beds (needle bed gap). As a result, the twist of knit stitches in the final course of the left sleeve is eliminated. FIG. 6 shows the principle of rotation. In step 0, it is assumed that the knitted fabrics 30, 31 face each other. In step 1, for example, the knitted fabric 31 on the backside is shifted to the left by racking. In step 2, knit stitches at both ends are transferred. Then, in step 3, the knitted fabric is shifted again. Thereafter, transferring and racking are repeated. In this manner, it is possible to rotate the knitted fabrics on the flat knitting machine.

Referring back to FIG. 5, in steps 3 and 4, for example, using a new yarn guide (yarn feeder) a, the left front sleeve is knitted two courses, and likewise, the left back sleeve is knitted two courses. Then, in step 5, two knit stitches of the left front sleeve are joined to the knit stitches at the end of the front body, and two knit stitches of the left back sleeve are joined to the knit stitches at the end of the back body. In the joining operation, the knitted fabric of the sleeve is transferred to the needle bed on the opposite side, and the knitted fabric is moved inwardly by two knit stitches to return the knitted fabric to the original needle bed. In steps 6 and 7, the front body with the left front sleeve, and the back body with the left back sleeve are knitted two courses, respectively. In step 8, narrowing stitches are provided inwardly for both of the front body and the back body by two stitches, respectively. Thus, the knitting width of the front body and the knitting width of the back body are reduced by two stitches, respectively. In steps 3 to 8, the left front sleeve and the left back sleeve are knitted four courses, respectively. The front body and the back body are knitted two courses, respectively. The number of stitches is decreased by four on the front side and on the backside, respectively.

In step 9, the knitted fabric is rotated in the opposite direction, e.g., clockwise such that the border h' between the front side and the backside of the right sleeve is positioned between the front needle bed and the back needle bed. Then, the right sleeve 10, the front body 4 and the back body 6 are knitted, for example, using a new yarn guide b in the same manner as the knitting operation in steps 3 to 8. As a result, a state shown at the top in FIG. 5 is obtained. From this state, the knitting operation is repeated from steps 2 to 15. In steps 3 to 15, both sleeves on the front side and the backside are knitted four courses, respectively. The front body and the back body are also knitted four courses, respectively. The left knitting width and the right knitting width, on the front side and the backside, are reduced by four stitches, respectively. Further, by selecting the position of inward narrowing stitches in steps 8 and 15, it is possible to change the pattern of attaching the sleeves or the like.

Figure 7:
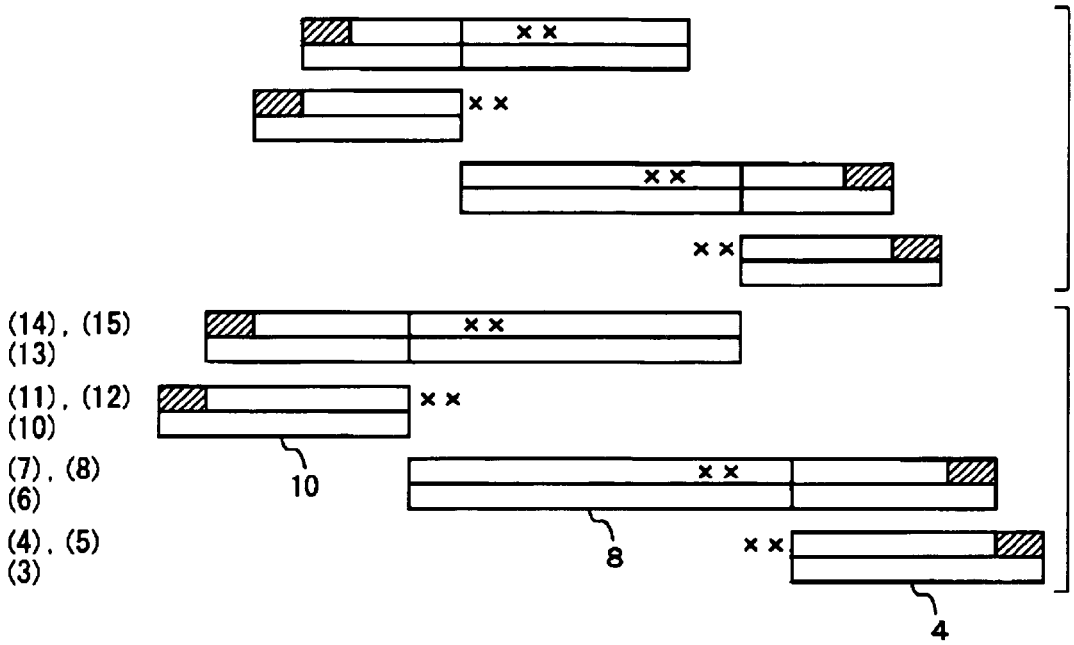
FIG. 7 is a view showing knitting courses and movement of knit stitches in the knitting operation of 4:4:4 in FIG. 6, on the part of a front body and both front sleeves.

FIG. 7 shows the knitting operation in FIG. 5 for the front body and both front sleeves. A horizontally extending field 34 denotes a knitting course (newly knitted knit stitch row). A reference numeral 36 denotes overlapping stitches. A reference numeral 38 denotes reduction in the knitting width (knitting width reduced by narrowing stitches). Common step numbers are used in FIGS. 5 and 7. Since the overlapping stitches formed in steps 8 and 15 are present within the front body, the border between the sleeve and the body is oriented obliquely inwardly to perform 4:4:4 knitting operation for joining. By repeating the knitting operation from steps 3 to 15, the sleeve is joined to the body.

Figure 8:
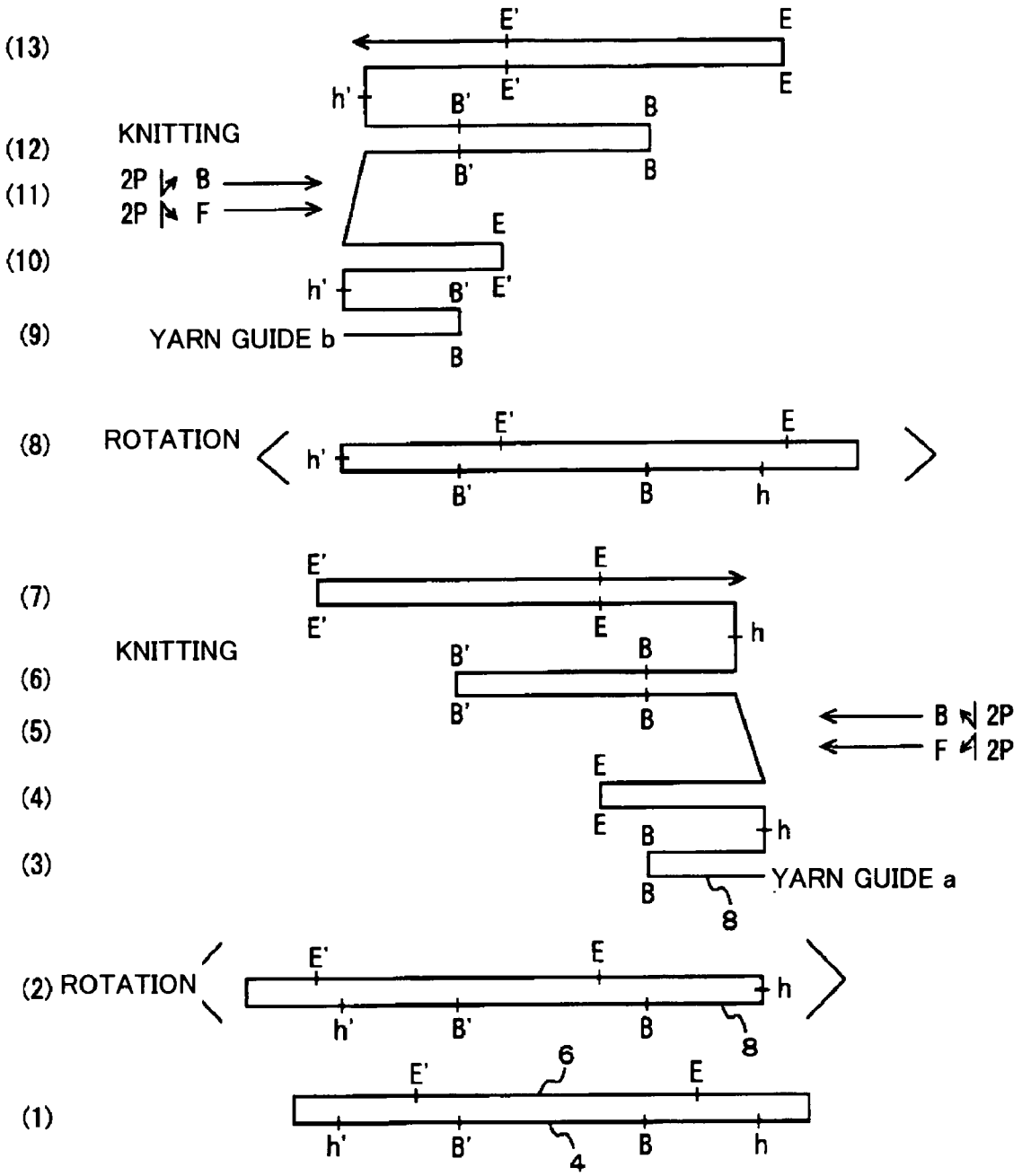
FIG. 8 is a view showing a knitting method in knitting operation of 4:4:2 in the embodiment.
Figure 9:
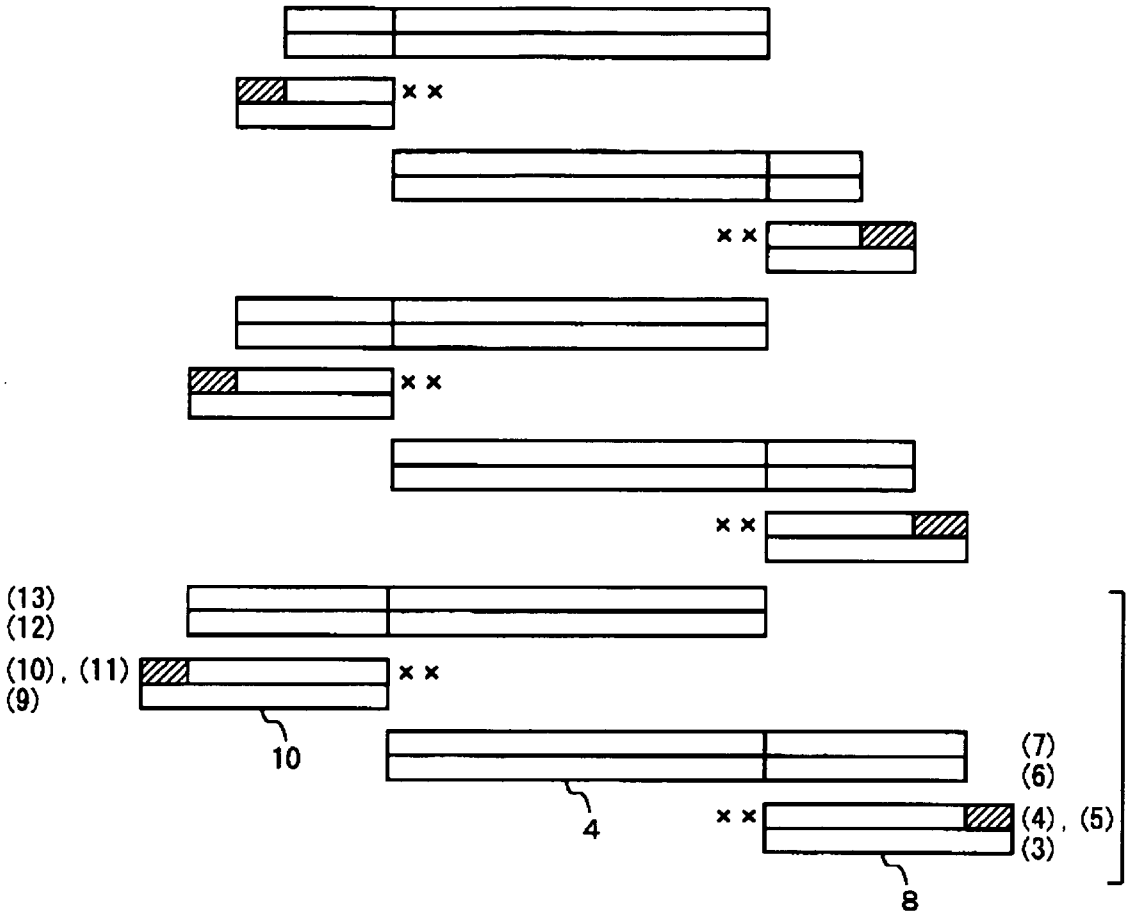
FIG. 9 is a view showing knitting courses and movement of knit stitches in the knitting operation of 4:4:2 in FIG. 8, on the part of the front body and both front sleeves.

FIGS. 8 and 9 show 4:4:2 knitting operation for joining. For example, in step 1, it is assumed that formation of the gores has been finished. In step 2, the knitted fabric is rotated, e.g., counterclockwise such that the border h between the front side and the backside of the left sleeve 8 is positioned between the front and back needle beds. For example, using a new yarn guide a, the left front and left back sleeves are knitted two courses, respectively (steps 3 and 4). Then, in step 5, two knit stitches of the left front sleeve are joined to the knit stitches at the end of the front body and two knit stitches of the left back sleeve are joined to the knit stitches at the end of the back body. In steps 6 and 7, the front and back bodies and the left front sleeve and the left back sleeve are knitted two courses, respectively.

In step 8, the knitted fabric is rotated in the opposite direction, i.e., clockwise. For example, using a new yarn guide b, in steps 9 to 13, knitting operation is carried out in the same manner as the knitting operation from steps 3 to 7. Then, the routine returns from step 13 to step 2, and the knitting operation is repeated from step 2 to step 13. In steps 2 to 13, the front and back sleeves are knitted four courses, respectively, and the front and back bodies are knitted four courses, respectively. The front and back sleeves are joined by two stitches on the left side and on the right side, respectively. Since the knitting width of the body is not reduced, the sleeves are attached to the body vertically.

FIG. 9 shows reduction in the knitting width of the left sleeve, and reduction in the knitting width of the right sleeve, and positions of joining the body and the sleeves on the front knitted fabric side, in the knitting operation for joining in FIG. 8. The sleeve is joined to the body by overlapping the knit stitches at the end of the sleeve on the inner side with the knit stitches at the end of the body on the outer side, and the knitting width of the sleeve is reduced.

Figure 10:
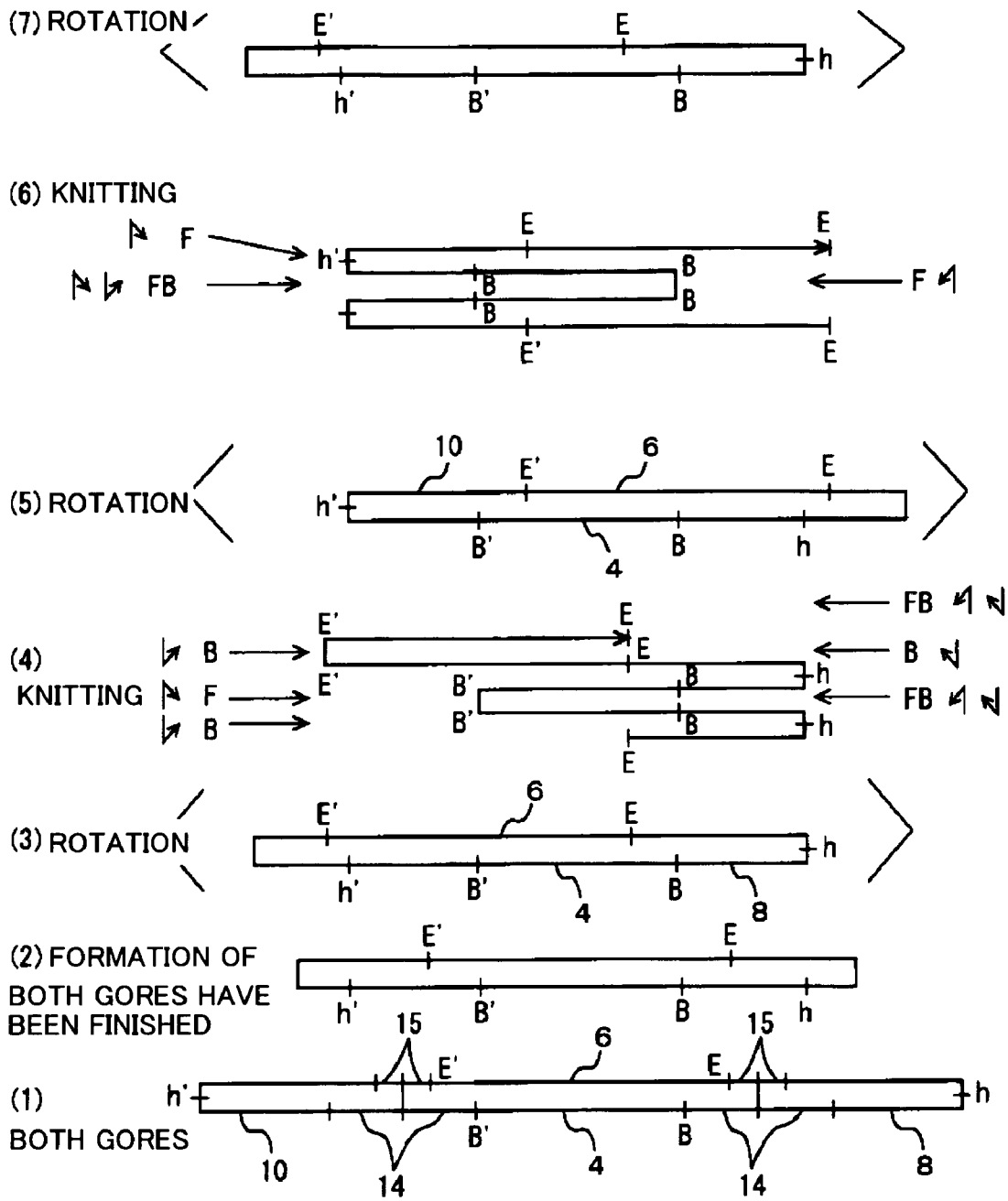
FIG. 10 is a view showing a knitting method in knitting operation of 2:4:3 in the embodiment.

FIG. 10 shows 2:4:3 knitting operation for joining. In steps 1 and 2, it is assumed that formation of the gores has been finished. In step 3, the knitted fabric is rotated, e.g., counterclockwise such that the border between the front side and the backside of the left sleeve 8 is positioned between the front and back needle beds. In step 4, the left front sleeve and the left back sleeve are knitted two courses, respectively, and the front body and the back body are knitted two courses, respectively. In the meanwhile, two knit stitches of the left front sleeve and three knit stitches of the left back sleeve are joined to knit stitches of the body. Further, two knit stitches of the right back sleeve and one knit stitch of the right front sleeve are joined to knit stitches of the body.

In step 5, the knitted fabric is rotated such that the border between the front side and the backside of the right sleeve is positioned between the front needle bed and the back needle bed. In step 6, the front body and the back body are knitted two courses, respectively, and right front sleeve and the right back sleeve are knitted two courses, respectively. In the meanwhile, one knit stitch of the left front sleeve is joined to the body, two knit stitches of the right front sleeve are joined to the body, and one knit stitch of the right back sleeve is joined to the body. Then, in step 7, the knitted fabric is rotated, and the routine returns to step 4. By the process, the knitting operation from steps 3 to 6 is repeated. During the period, the front sleeve and the back sleeve are knitted two courses, respectively, the front body and the back body are knitted four courses, respectively, and the front and back sleeves are joined by three stitches on the left side and on the right side, respectively.

By changing the course knitting, the joining proportion, and the position of forming the overlapping stitches, e.g., by changing the knitting operation to, e.g., (4:4:4), (4:4:2), (2:4:3), the sleeves can be attached to the body in the desired pattern. In any case, the knitting width of the front body is narrower than the knitting width of the back body. In the sleeve cap (part of the sleeve above the underarm position), the front side is narrower than the backside. Therefore, the armhole is oriented forward naturally. Thus, the sweater fits the human body. Wrinkles are few on the front side, and the stress is small on the backside. At the time of knitting operation of the sleeves for joining the sleeves to the body, the knitted fabric is rotated such that the border between the front side and the backside of the sleeve is positioned between the front needle bed and the back needle bed. Therefore, no twisted stitches are formed. Further, since no flechage knitting is performed, even if the flat knitting machine does not have any movable sinker device, knitting operation is performed easily. Alternatively, flechage knitting may be used in combination with the present invention. For example, part of the sleeve cap may be knitted by flechage knitting prior to formation of the gore.

Figure 11:
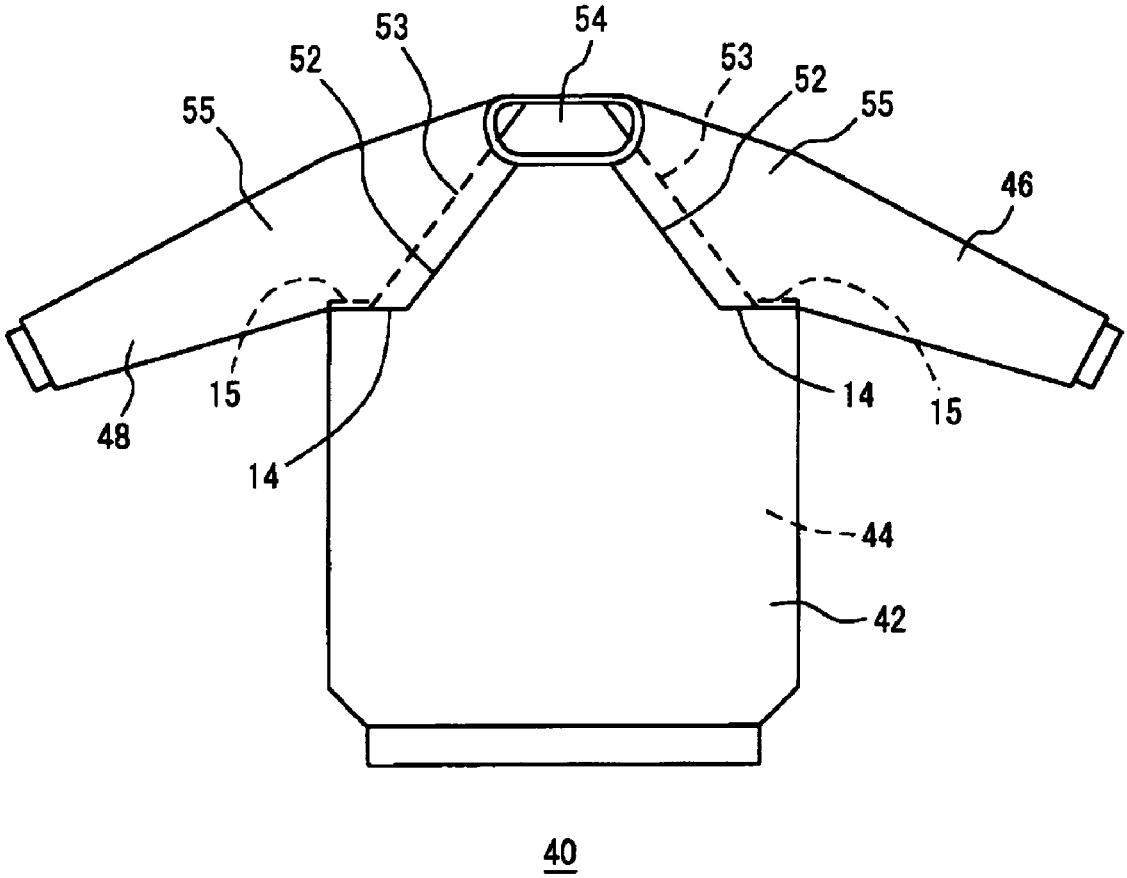
FIG. 11 is a view schematically showing a raglan sweater knitted in the embodiment.

FIG. 11 shows an example in which the embodiment is applied to a raglan sweater 40. A reference numeral 42 denotes a front body, a reference numeral 44 denotes a back body, a reference numeral 46 denotes a left sleeve, and a reference numeral 48 denotes a right sleeve. Gores 14, 14 on the front side are wider than gores 15, 15 on the backside. Joining lines 52 between the sleeves 46, 48 and the front body 42 are positioned inside joining lines 53 between the sleeves 46, 48 and the back body 44. A reference numeral 54 denotes a neck hole. The gores 14, 15 are formed such that the gores 14 on the front side become wider than the gores 15 on the backside. Further, sleeve caps 55 on the front side are narrower than sleeve caps 55 on the backside. A suitable knitting operation such as 4:4:4 is performed for the joining lines 52, 53 to reduce the knitting width of the body at a predetermined pitch. In the case of the raglan sleeves, since high sleeve caps are popular, the wale of the sleeve caps may be knitted by flechage knitting before formation of the gores.

Figure 12:
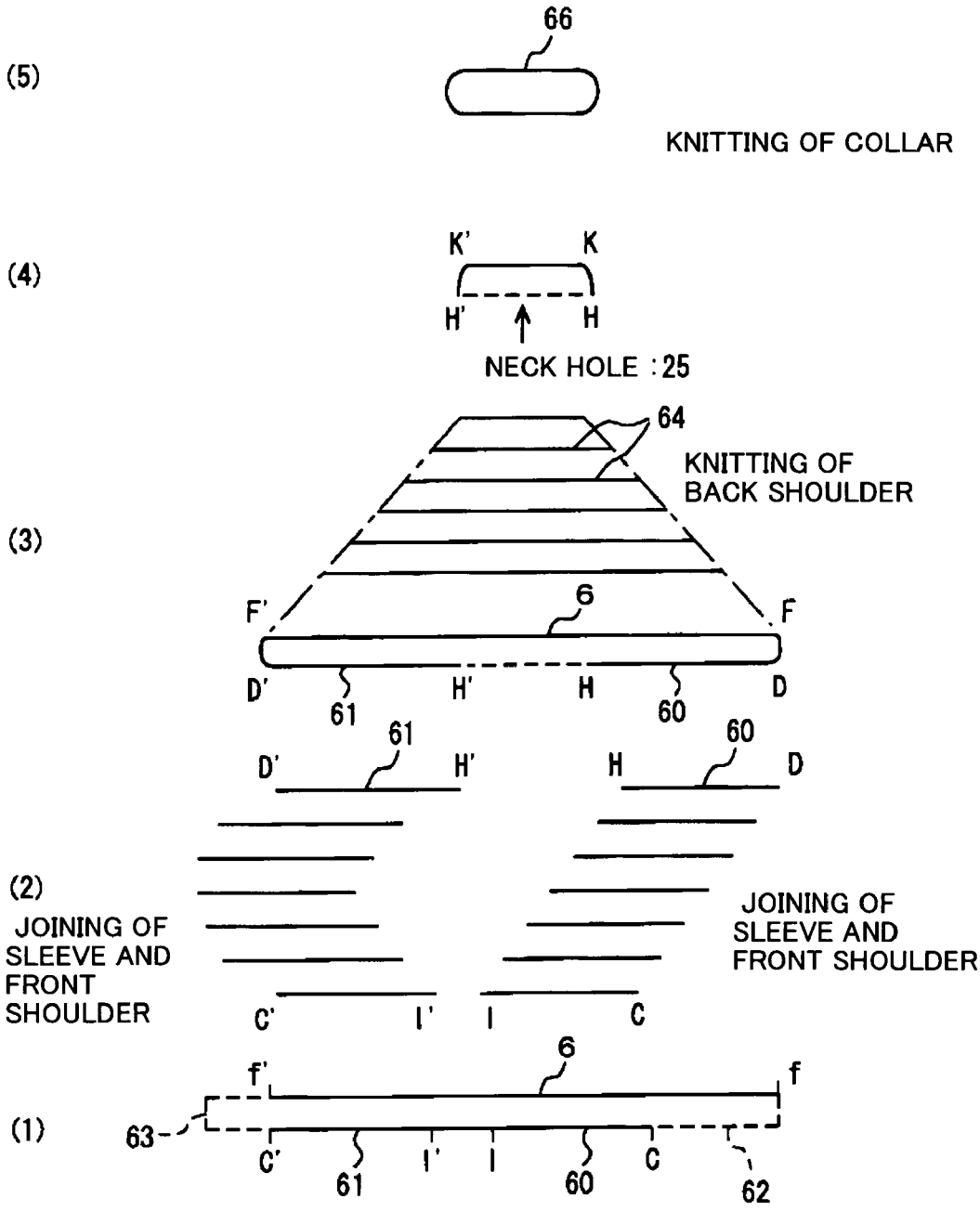
FIG. 12 is a view showing the overview of the knitting operation after joining the body and the sleeves in the embodiment.

FIG. 12 shows the steps of knitting from the portion of the neck hole 25. Step 1 schematically shows a state before knitting the portion of the neck hole 25. I–I' denotes the lower end of the neck hole. Step 2 schematically shows knitting of a left front shoulder 60 and a right front shoulder 61, and joining the left front shoulder 60 and the right front shoulder 61 to the sleeves. A reference numeral 62 denotes the final course of the left sleeve, and a reference numeral 63 denotes the final course of the right sleeve. Knitting is carried out such that the knitted fabric gradually moves toward the sleeve side. For example, knitting is carried out while moving the knitted fabric for every predetermined number of courses, e.g., two courses. If necessary, widening stitches are formed on the left side of the left front shoulder 60 and on the right side of the right front shoulder 61 to increase the knitting width. In the meanwhile, the sleeves and the front shoulders are joined together. The knit stitches, at the left and right ends of the front shoulders, and the knit stitches, at the ends of the sleeves, are overlapped with and joined together. During the knitting operation, the positions of the opposite ends of the left front shoulder 60 are changed from the points I to C to the points H to D, and the positions of the opposite ends of the right front shoulder 61 are changed from the points I' to C' to points H' to D'.

In step 3, the back shoulder 64 at the upper part of the back body 6 is knitted. While gradually reducing the knitting width, the knit stitches of the back shoulders 64 and the knit stitches of the front shoulders 60, 61 are overlapped with, and joined together. Thus, the sweater 2 becomes a state in step 4. The reference numeral 25 denotes the neck hole. From this state, a collar 66 is knitted to complete the sweater 2.

Figure 13:
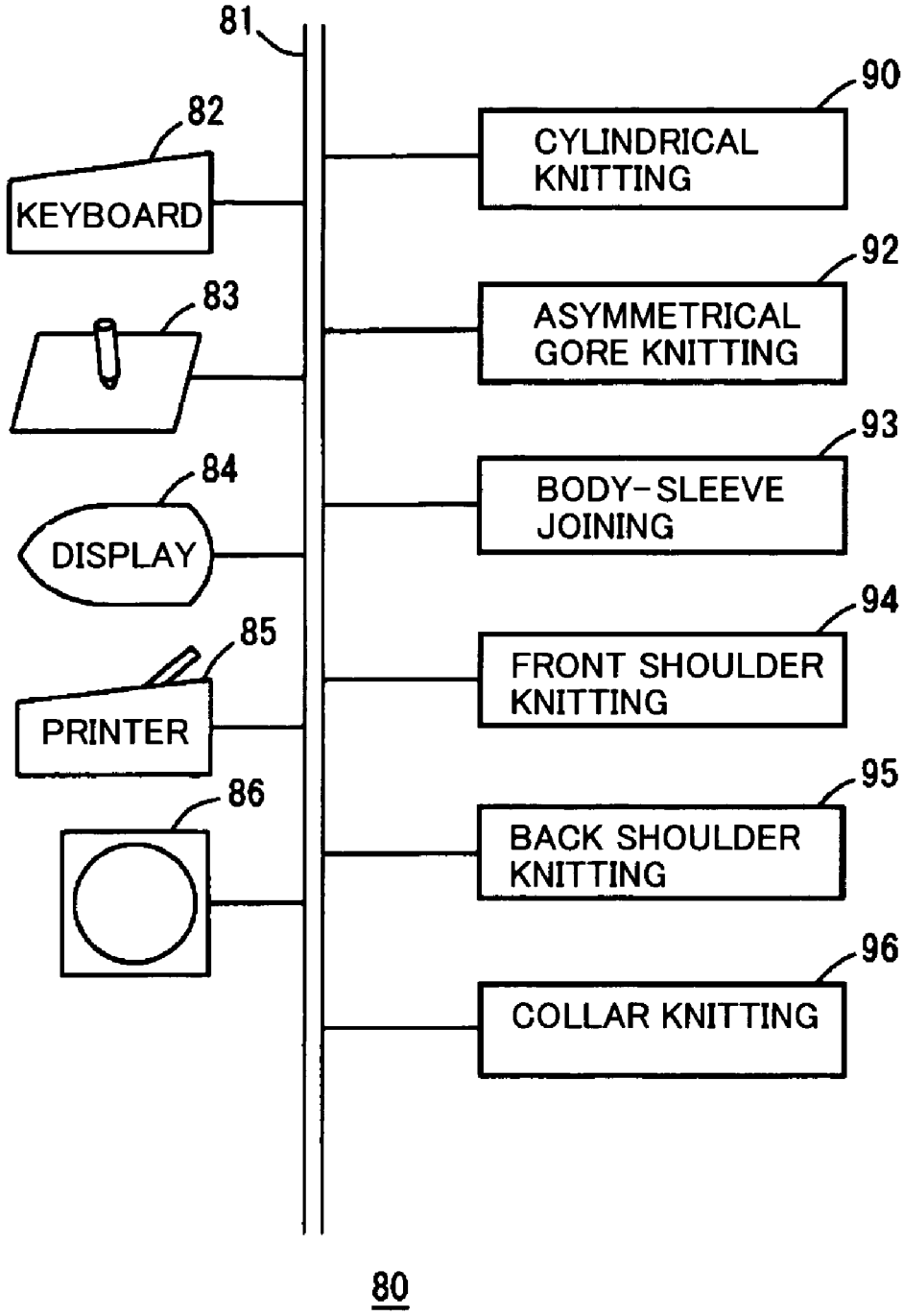
FIG. 13 is a block diagram showing a knit design device supporting knitting of the garment with asymmetrically joined sleeves in the embodiment.
Figure 14:
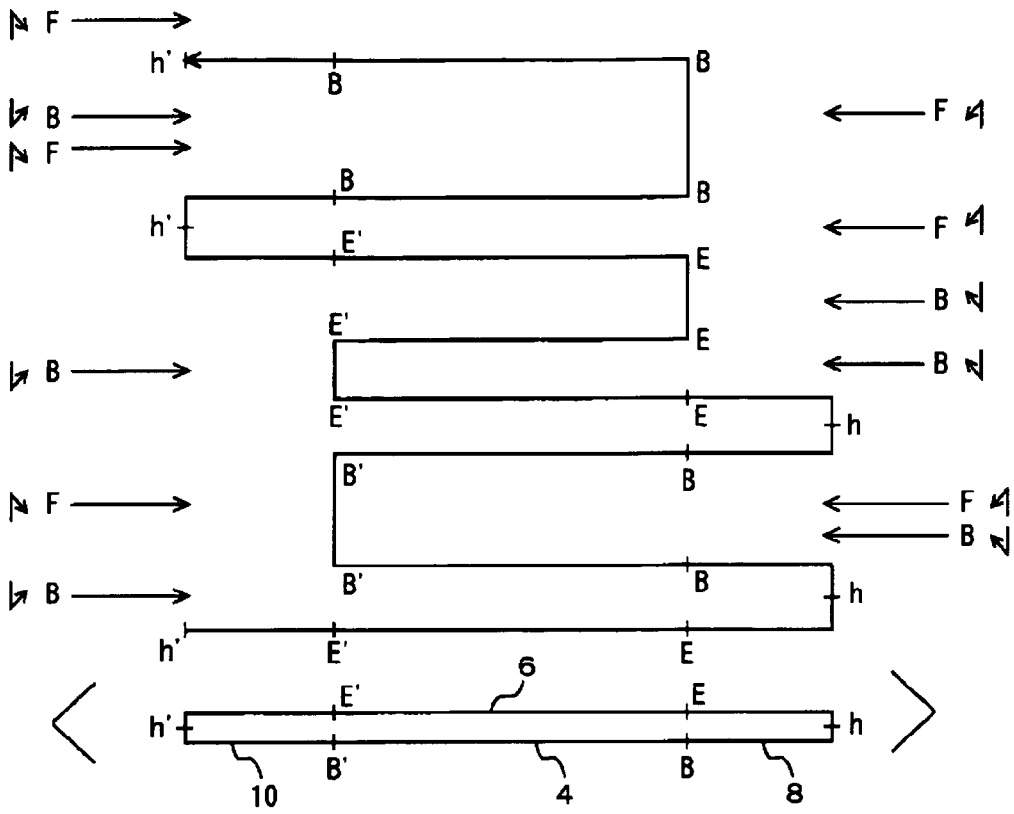
FIG. 14 is a view showing a knitting method in knitting operation of 2:4:3 in a conventional example.
Figure 15:
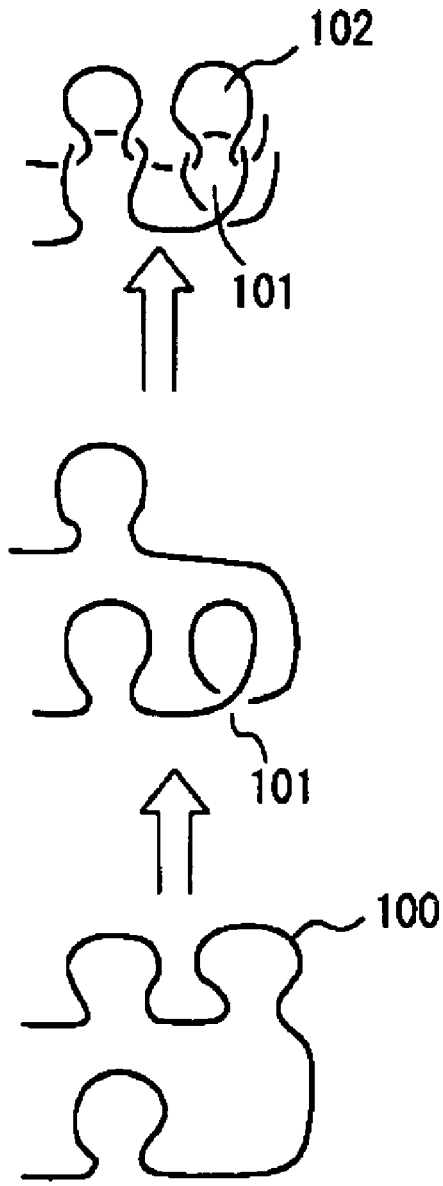
FIG. 15 is a view schematically showing generation of twisted stitches in the conventional example.

FIG. 13 shows a knit design device 80 used in the embodiment. The knit design device 80 is intended to generate knitting data for the garment with asymmetrically joined sleeves which have been described in connection with the embodiment, in accordance with the design of the user. A reference numeral 81 denotes a bus, a reference numeral 82 denotes a keyboard, and a reference numeral 83 denotes a stylus. Additionally, input devices such as a mouse or a track ball may be provided. A reference numeral 84 denotes a display such as a color monitor, a reference numeral 85 denotes a color printer, and a reference numeral 86 denotes a disk. Further, the knit design device 80 may be connectable to a LAN.

A cylindrical knitting unit 90 generates knitting data needed for cylindrically knitting the body up to the underarm positions or both sleeves in accordance with the design of the user. The components as described later also generate knitting data for respective parts in accordance with the design of the user. An asymmetrical gore knitting unit 92 generates knitting data of front and back gores. The front gore and the back gore are asymmetrical. The front gore is larger than the back gore. The back gore may not be provided. A body sleeve joining unit 93 generates data for joining the front body and the back body to the sleeves above the underarm positions, and course knitting of the front body and the back body, and the sleeves. A front shoulder knitting unit 94 generates knitting data for knitting the front shoulder and joining the front shoulder to the sleeve. A back shoulder knitting unit 95 generates knitting data for knitting operation of joining the back shoulder and the front shoulder. Knitting of the back shoulder may be carried out mainly for joining and only a small number of knit stitches may be formed. Alternatively, a large number of knit stitches may be formed at the time of knitting the back shoulder. A collar knitting unit 96 generates knitting data for the collar.

In the embodiment, a pair of yarn guides (yarn feeders) are used in the knitting operation for joining the sleeves and body. However, if the knitting course can be drawn with a single stroke, it is possible to use only one yarn feeder.

In the embodiment, it is possible to knit the garment with asymmetrically joined front and back sleeves. The sleeves are oriented forward, and the garment fits the body shape. Further, when the garment is worn, wrinkles are few on the front side, and the stress is small on the backside. Thus, a beautiful silhouette can be obtained. In the embodiment, a sweater is used as an example. Alternatively, the present invention is also applicable to other garments such as a one-piece suit, a dress, or a vest.

Brief Description of Symbols

| | |
|---|---|
| 2 | Sweater |
| 4 | Front Body |
| 6 | Back Body |
| 8 | Left Sleeve |
| 10 | Right Sleeve |
| 14, 15 | Gore Forming Portion |
| 20–24 | Joining Line |
| 25 | Neck Hole. |
| 30, 31 | Knitted Fabric |
| 34 | Knitting Course |
| 36 | Overlapping Stitch |
| 38 | Reduction in Knitting Width |
| 40 | Raglan Sweater |
| 42 | Front Body |
| 44 | Back Body |
| 46 | Left Sleeve |
| 48 | Right Sleeve |
| 52, 53 | Joining Line |
| 54 | Neck Hole |
| 55 | Sleeve Cap |
| 60 | Left Front Shoulder |
| 61 | Right Front Shoulder |
| 64 | Back Shoulder |
| 66 | Collar |
| 80 | Knit Design Device |
| 81 | Bus |
| 82 | Keyboard |
| 83 | Stylus |
| 84 | Display |
| 85 | Color Printer |
| 86 | Disk |
| 90 | Cylindrical Knitting Unit |
| 92 | Asymmetrical Gore Knitting Unit |
| 93 | Body Sleeve Joining Unit |
| 94 | Front Shoulder Knitting Unit |
| 95 | Back Shoulder Knitting Unit |
| 96 | Collar Knitting Unit |
| 100 | Knit Stitch |
| 101 | Twisted Stitch |
| 102 | Knit Stitch |
| H, H' | Border Between Front Side and Back Side of Sleeve |
| B, B' | Both Ends of Front Body at Underarm Position |
| E, E' | Both Ends of Back Body at Underarm Position |

The invention claimed is:

1. A method of knitting a garment with asymmetrically joined sleeves by knitting a body and both the sleeves up to underarm positions to have cylindrical shapes, respectively, then, joining both the sleeves to the body, and then, joining upper ends of a front body and a back body of the body, on a flat knitting machine having a pair of front and back needle beds, the method comprising the steps of:

(a) forming gores at the underarm positions for connecting front sleeves of both the sleeves and the front body without forming any gores between back sleeves of both the sleeves and the back body, or forming gores at the underarm positions for connecting both the front sleeves and the front body such that the gores between both the back sleeves and the back body become smaller than the gores between both the front sleeves and the front body in the case of forming the gores between both the back sleeves and the back body;

(b) rotating at least one of the sleeves and the body in a first direction on the flat knitting machine such that a border between a front side and a backside of the one of the sleeves is positioned between the pair of front and back needle beds, and while knitting the one of the sleeves and the front and back bodies, joining the front and back bodies to the one of the sleeves; and (c) rotating at least the other of the sleeves in a direction opposite to the first direction on the flat knitting machine such that a border between a front side and a backside of the other of the sleeves is positioned between the pair of front and back needle beds, and while knitting the other of the sleeves and the front and back bodies, joining the front and back bodies to the other of the sleeves.

2. The knitting method of claim 1, wherein the step (b) and the step (c) are repeated alternately.

3. A garment with asymmetrically joined sleeves including: a body comprising a cylindrical knitted fabric; and both the sleeves, each comprising a cylindrical knitted fabric, wherein the body and both the sleeves are joined on sides by knitting operation without sewing, and a front body and a back body of the body are joined at shoulders, on a flat knitting machine having at least a pair of front and back needle beds, and wherein (a) front portions of both the sleeves are joined to the front body at underarm positions using gores and back portions of both the sleeves and the back body are joined at underarm positions without pores or with other pores smaller than the pores between the front portions of both the sleeves and the front body;

(b) the front portions of both the sleeves are narrower above the underarm positions in width than the back portions of both the sleeves;

(c) the front body is narrower above the underarm positions in width than the back body; and (d) the front body and the back body are joined to both the sleeves by overlapping knit stitches without any twist on sides, by alternately repeating the steps of:

rotating the garment on the flat knitting machine such that a border between a front side and a backside of one of the sleeves is positioned between the pair of front and back needle beds, and while knitting the one of the sleeves and the front and back bodies, joining the front and back bodies to the one of the sleeves; and rotating the garment on the flat knitting machine such that a border between a front side and a backside of the other of the sleeves is positioned between the pair of front and back needle beds, and while knitting the other of the sleeves and the front and back bodies, joining the front and back bodies to the other of the sleeves.

4. A knit design device generating knitting data for knitting a garment by knitting a body and both sleeves up to underarm positions to have cylindrical shapes, respectively, then, joining both the sleeves to the body, and then, joining upper ends of a front body and a back body of the body, on a flat knitting machine having a pair of front and back needle beds, the knitting data being used by the flat knitting machine for carrying out the steps of:

(a) forming gores at the underarm positions for connecting front sleeves of both the sleeves and the front body without forming any gores between back sleeves of both the sleeves and the back body, or forming gores at the underarm positions for connecting both the front sleeves and the front body such that the gores between both the back sleeves and the back body become smaller than the gores between both the front sleeves and the front body in the case of forming the gores between both the back sleeves and the back body;

(b) rotating at least one of the sleeves and the body in a first direction on the flat knitting machine such that a border between a front side and a backside of the one of the sleeves is positioned between the pair of front and back needle beds, and while knitting the one of the sleeves and the front and back bodies, joining the front and back bodies to the one of the sleeves; and (c) rotating at least the other of the sleeves in a direction opposite to the first direction on the flat knitting machine such that a border between a front side and a backside of the other of the sleeves is positioned between the pair of front and back needle beds, and while knitting the other of the sleeves and the front and back bodies, joining the front and back bodies to the other of the sleeves, wherein the steps are carried out in the order of (a) to (c).

* * * * *